United States Patent [19]

Spralja

[11] Patent Number: 4,974,488

[45] Date of Patent: Dec. 4, 1990

[54] ROPE SLICING APPARATUS AND METHOD

[76] Inventor: Boris Spralja, 3971 Charles Street, Burnaby, British Columbia, Canada, V5C 5S7

[21] Appl. No.: 448,261

[22] Filed: Dec. 11, 1989

[51] Int. Cl.[5] ..... D04C 1/12; D07B 7/18

[52] U.S. Cl. ..... 87/8; 57/23; 57/202

[58] Field of Search ..... 57/22, 23, 202; 87/8, 87/13, 33, 34

[56] References Cited

U.S. PATENT DOCUMENTS

| | | | |
|---|---|---|---|
| 961,201 | 6/1910 | Altheide | 57/23 |
| 1,010,963 | 12/1911 | Schuttee | 57/23 |
| 2,112,176 | 3/1938 | Olsson | 57/23 |
| 4,036,101 | 7/1977 | Burnett | 87/8 |
| 4,099,750 | 7/1978 | McGrew | 289/1.5 |
| 4,413,847 | 11/1983 | Doyel | 289/17 |

OTHER PUBLICATIONS

Splicing Manual, 1983 Edition, Samson Ocean Systems, Inc.

Herzog Splicing Manual, Prior to Dec. 11, 1988.

*Primary Examiner*—John Petrakes

*Attorney, Agent, or Firm*—Shlesinger & Myers

[57] ABSTRACT

The invention provides a rope splicing apparatus having an elongated tool portion including a main portion, a tip portion and a transitional portion. The main portion comprises a pair of straight and parallel main rod portions which are spaced apart at a main portion width along the length thereof. The tip portion comprises a generally U-shaped rod portion having a bend portion and leg portions which are spaced apart at a width narrower than the main portion width. The transitional portion has a pair of short rod portions flaring outwardly from the tip portion to interconnect the main rod portion to form a unitary tool. The tip portion is of a size which can penetrate strands of a single or dual braid rope to draw portions of the rope therethrough. The apparatus is used to practice a method of splicing such ropes to form eye splices, and marriage splices, with less difficulty than using conventional fids.

19 Claims, 10 Drawing Sheets

| MAIN DIMENSIONS OF TOOL, INCHES | | | | | | | | | | | |
|---|---|---|---|---|---|---|---|---|---|---|---|
| MODEL NO. | ROPE DIA. | ROPE CIRC. | HANDLE GAUGE | | TOOL GAUGE | | WIRE THICKNESS | MAIN PORTION LENGTH | MAIN PORTION WIDTH | TIP PORTION WIDTH | TIP PORTION LENGTH |
| | | | TYPE | LENGTH | TYPE | LENGTH | | | | | |
| 1 | 1/4<br>5/16<br>3/8 | 3/4<br>1<br>1 1/8 | 1st<br>2nd<br>2nd | 2 1/8<br>2 3/4<br>2 3/4 | 3rd<br>4th<br>5th | 5 1/2<br>6 3/4<br>7 3/4 | 1/16 | 5 | 5/16 | 3/16 | 1/4 |
| 2 | 7/16<br>1/2<br>9/16 | 1 1/4<br>1 1/2<br>1 3/4 | 1st<br>2nd<br>2nd | 3 1/2<br>4 1/8<br>4 1/8 | 3rd<br>4th<br>5th | 9 1/2<br>11<br>12 1/2 | 3/32 | 8 3/8 | 9/16 | 5/16 | 1/2 |
| 3 | 5/8<br>3/4<br>7/8 | 2<br>2 1/4<br>2 3/4 | 1st<br>2nd<br>2nd | 4 1/8<br>4 3/4<br>4 3/4 | 3rd<br>4th<br>5th | 13<br>15 1/2<br>16 1/2 | 1/8 | 11 3/4 | 3/4 | 7/16 | 3/4 |

FIG. 3

ROPE SLICING APPARATUS AND METHOD

BACKGROUND OF THE INVENTION

The invention relates to an apparatus and method for splicing rope, in particular to form splices in single hollow braid ropes or dual braid ropes fabricated from synthetic fibers and as used extensively in the marine industry.

The marine industry uses synthetic ropes extensively, which ropes are typically fabricated from polypropylene fibers for light duty, or from nylon fibers for heavier duty. Two main types of ropes are used, namely, laid ropes and braid ropes. Laid ropes are not discussed further. Braid ropes are available as single hollow braid ropes or dual braid ropes having a hollow cover enclosing a hollow core. In both types of braid ropes, the braid can be relatively loose which permits the rope to flatten somewhat when passing over a sheave or edge. The rope is made from bundles of strands or fibers which are braided together to form a generally cylindrical sheath, or two concentric cylindrical sheathes Two main types of splices are an eye splice which forms a closed loop or an eye at the end of a length of rope, and a marriage splice, which joins two ends of ropes together. It is known to form either of these types of splices using a fid, which functions as a needle to draw one portion of the rope through an adjacent portion of the rope. There are many difficulties associated with using fids, the main difficulties being in joining the rope to the fid itself, and forcing the fid through the rope. The rope is joined to the fid by whipping with a fine thread or by using an adhesive tape. This-can be time-consuming and frustrating, particularly when the ends of the strands are frayed and also require to be constrained by the thread or tape. Furthermore, because rope is used in many different sizes, and a particular size of fid can accommodate only a relatively narrow range of rope sizes, many different sizes of fids are necessary. Consequently, to splice a wide range of ropes, a kit comprising a wide range of fid sizes is required. When a portion of the prior art rope has been secured to the fid, the fid and its associated length of rope is forced between strands of a remaining portion of rope or another rope, commonly using a pushing tool to assist in penetrating the strands to push the fid into the rope. The fid is followed by the rope which can then be pulled to pass between the strands. With older heavier ropes, considerable force can be required to push the fid between the strands. Using a conventional fid requires some considerable skill and splicing a rope using such apparatus is time-consuming especially when splicing old, heavily used ropes in which the fibers can be very stiff. One method of forming an eye splice in a double braid line is described and claimed in U.S. Pat. No. 4,099,750 issued to McGrew. Other types of fids have been employed to produce similar splices.

SUMMARY OF THE INVENTION

The invention reduces the difficulties and disadvantages of the prior art by providing a rope splicing apparatus which simplifies considerably the method of splicing, and eliminates the use of the prior art fid and also reduces the difficulty of securing the rope to the rope penetrating tool. The apparatus provides a tool which can be easily threaded and yet grips the rope without requiring taping of the rope to the apparatus, and furthermore penetrates the strands of the rope more easily than conventional fids. In addition, the apparatus can be made in three main sizes which can accommodate a wide range of rope sizes and types, thus eliminating the prior art requirement for many different sizes of apparatus to perform splicing.

The rope splicing apparatus according to the invention has an elongated tool portion which includes a main portion, a tip portion and a transitional portion. The main portion comprises a pair of generally straight and parallel main rod portions which are spaced apart at a main portion width along the length of the main portion. The tip portion comprises a generally U-shaped rod portion having two generally straight leg portions connected to a bend portion. The leg portions are spaced apart at a tip portion width which is narrower than the main portion width. The transitional portion comprises a pair of short rod portions flaring outwardly from the leg portions of the main portion to interconnect the main rod portions with the leg portions. Preferably, the rod portions of the main portion, the transitional portion and the tip portion are all co-planar and comprised of bent wire rod portions of similar diameters connected smoothly together. To simplify the splicing method, the main portion has graduations thereon to reflect length measurements dependent on rope size to mark off a portion of the rope prior to splicing.

A method of the invention for eye splicing a dual braid rope uses an elongated tool portion having a tip portion. The rope has a hollow core and a hollow cover, the cover normally enclosing the core. The method includes the steps of:

inserting the tip portion of the tool through the cover of the rope at a first position on the rope spaced from an adjacent end of the rope to generate a first opening in the cover and to determine a throat position of the eye splice, withdrawing a portion of the core extending to the adjacent end of the rope through the first opening in the cover so that the core and cover extend as a separate core end portion and a cover end portion from the first position, inserting the tip portion of the tool portion into the core end portion at a second position closely adjacent the first position, feeding the tool portion axially along the core end portion in a direction away from the first position so that a length of the tool portion lies inside the core end portion, and extending the tip portion of the tool portion outwardly from the core end portion at a third position on the core end portion, threading the cover end portion of the rope through the tool portion and gripping the cover end portion of the rope with the tip portion, withdrawing the tool portion and the cover end portion backwardly through the core end portion so as to draw a length of the cover end portion in through the third position and out from the second position of the core end portion until a desired size of eye is attained so that a first length of the cover end portion extends within the core end portion between the third and second positions, and separating the cover end portion from the tool portion, cutting the cover end portion to length closely adjacent the second position of the core and stroking portions of the core and cover adjacent the second position as required to smooth the cover end portion into the adjacent portion of the core end portion, inserting the tip portion of the tool portion into the cover end portion at a fourth position generally adjacent the first position, feeding the tool portion axially along the cover end portion in a direction away from the first position so that a length of tool portion lies inside the cover end portion, and extending the tip portion of the tool portion outwardly from the cover end portion at a fifth position on the cover end portion, threading the core end portion through the tool portion and gripping the core end portion with the tip portion, withdrawing the tool portion and the core end portion backwardly through the cover end portion so as to draw a length of the core end portion in through the fifth position and out through the fourth position of the cover end portion so that a first length of core end portion extends within the cover end portion from the fifth position to the fourth position, and separating the core end portion from the tool portion, inserting the tip portion into a sixth position on the cover on a side of the eye remote from the second and fourth positions, feeding the tool portion axially along the rope portion between the core and the cover in a direction away from the sixth position and towards and past the first position of the cover end portion, and extending the tip portion of the tool outwardly from the cover end portion at the fourth position, threading the core end portion through the tool portion and gripping the core end portion with the tip portion, withdrawing the tool portion and the core end portion backwardly through the fourth position, past the first position and outwardly of the sixth position so that a third length of the core end portion extends within the cover end portion from the fourth to the first position, and a fourth length of core end portion extends between the core and the cover of the main rope from the first position to the sixth position, and separating the core end portion from the tool portion, cutting the core end portion to length adjacent the sixth position and stroking portions of the rope as required to smooth the core end portion into the main portion of the rope.

A method of the invention for eye splicing a single hollow braid rope uses a similar elongated tool. The method includes the steps of:

inserting the tip portion through a first position on the rope spaced from an adjacent end of the rope, to determine a throat position of the eye splice, the tip portion extending outwardly from the rope, threading an end portion of the rope through the tool portion and gripping the end portion of the rope with the tip portion, withdrawing the tool portion and the end portion of the rope backwardly through the first position of the rope, and drawing the end portion of the rope through the first position of the rope to form a desired size of eye which now extends from a main portion of the rope, and separating the end portion of the rope from the tool portion, inserting the tip portion through a second position on the main portion of the rope, the second position being spaced from the first position and on a side thereof remote from the eye, the tip portion extending outwardly from the main portion of the rope, threading the end portion of the rope through the tool portion and gripping the end portion of the rope with the tip portion, withdrawing the tool portion and the end portion of the rope backwardly through the second position of the main portion of rope and drawing the end portion of the rope through the second position of the main portion until a first remaining length of rope extends generally parallel to the main portion of the rope and outside the main portion from the first position to the second position, inserting the tip portion into a third position of the main rope, the third position being spaced from the second position and on a side thereof remote from the first position, and feeding the tool portion axially along and within the rope in a direction generally towards the first and second positions, extending the tip portion outwardly from the rope through a fourth position spaced along the rope from the third position towards the second position so that a length of the tool portion lies within a second of the main rope between the third and fourth positions, threading the end portion of the rope through the tool portion and gripping the end portion with the tip portion, withdrawing the tool portion and the end portion of the rope backwardly through the fourth position and into and axially along the rope, and then outwardly of the rope at the third position so that the end portion of the rope is withdrawn completely through and extends from the fourth position, and separating the end portion of the rope from the tool portion, so that a second remaining length of rope extends generally parallel to the main rope outside the main rope from the second position to the thirds position and a third remaining length of rope extends generally parallel to the main rope portion and inside the main rope from the fourth position to the third position, cutting the end portion of the rope to length closely adjacent the third position and stroking portions of the rope as required to smooth the end portion of the rope into the adjacent main portion of the rope.

A method of marriage splicing a dual braid rope using a similar tool includes the steps of:

inserting the tip portion of the tool through the cover of each rope at a first position on each rope spaced from an adjacent end of each rope to generate respective first openings in the respective covers so as to determine a junction of the marriage splice for each rope, withdrawing a portion of the core extending to the adjacent end of each rope through the respective first opening in the cover, so that a first core end portion and a first cover end portion extend separately from the first position of the rope, and a separate second core end portion and a second cover end portion extend separately from the first position of the second rope, inserting the tip portion of the tool portion into the first core end portion at a second position closely adjacent the first position there, feeding the tool portion axially along the first core end portion in a direction away from the first position so that a length of the tool portion lies inside the first core end portion, and extending the tip portion of the tool portion outwardly from the first core end portion at a third position on the first core end portion, threading the second cover end portion of the second rope through the tool portion and gripping the second cover end portion with the tip portion, withdrawing the tool portion and the second cover end portion backwardly through the first core end portion of the first rope so as to draw a length of the second cover end portion in through the third position of the first rope and out from the second position of the first core end portion and separating the second cover end portion from the tool portion, inserting the tip portion of the tool portion into the second core end portion at a second position closely adjacent the first position thereof, feeding the tool portion axially along the second core end portion in a direction away from the first position thereof so that a length of the tool portion lies inside the second core end portion, and extending the tip portion of the tool portion outwardly from the first core end portion at a third position on the first core end portion, threading the first cover end portion of the first rope through the tool portion and gripping the first cover end portion with the tip portion, withdrawing the tool portion and the first cover end portion backwardly through the second cover end portion of the second rope so as to draw a length of the first cover end portion in through the third position of the second rope and out from the second position of the second core end portion, and separating the first cover end portion from the tool portion, cutting the first and second cover end portions to length closely adjacent the second position of the respective second and first core end portions, and stroking portions of the core and cover adjacent the respective second positions as required to smooth the cover end portion into the adjacent portion of the core end portion, inserting the tip portion of the tool portion into the cover end portions at a fourth position adjacent the respective first position, feeding the tool portion axially along the first cover end portion in a direction away from the respective first position so that a length of tool portion lies inside the first cover end portion, and extending the tip portion of the tool portion outwardly from the first cover end portion at a fifth position on the first cover end portion, threading the second core end portion of the second rope through the tool portion and gripping the core end portion with the tip portion, withdrawing the tool portion and the second core end portion backwardly through the first cover end portion so as to draw a length of the core end portion in through the fifth position and out through the fourth position of the first cover end portion so that a first length of second core end portion extends within the first cover end portion from the fifth position to the fourth position thereof, and separating the core end portion from the tool portion, inserting the tip portion of the tool portion in to the second cover end portion at a fourth position adjacent the respective first position, feeding the tool portion axially along the second cover end portion in a direction away from the respective first position so that a length of the tool portion lies inside the second cover end position, and extending the tip portion of the tool portion outwardly from the second cover end portion at a fifth position on the second cover end portion, threading the core end portion of the first rope through the tool portion and gripping the core end portion with the tip portion, withdrawing the tool portion and the first core end portion backwardly through the second cover end portion so as to draw a length of the first core end portion in through the fifth position and out through the fourth position of the second cover end portion so that a first length of the first cover end portion extends within the second cover end portion from the fifth position to the fourth position thereof, and separating the core end portion from the tool portion, cutting the core end portion to length adjacent the fourth position and stroking portions of the rope as required to smooth the core end portion into the cover end portion.

DESCRIPTION OF THE DRAWINGS

FIG. 3 is a table showing important dimensions and gauge lengths of three sizes of the apparatus which can handle a wide range of rope sizes.

DETAILED DISCLOSURE

FIGS. 1 through 6

Figure 1:
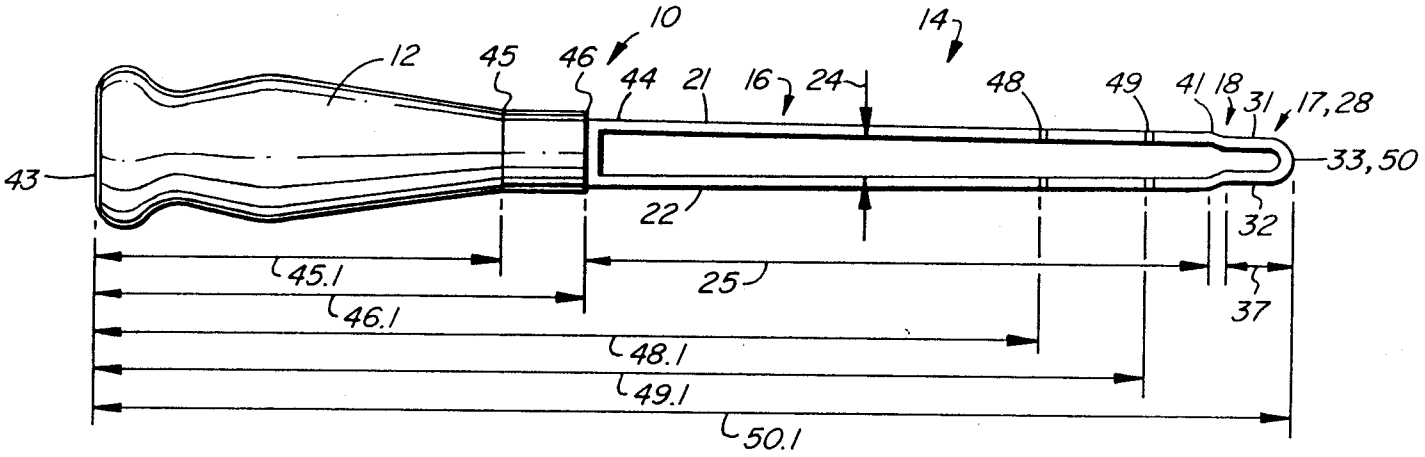
FIG. 1 is a top plan of a first embodiment of a splicing apparatus for practising the method of the invention.
Figure 5:
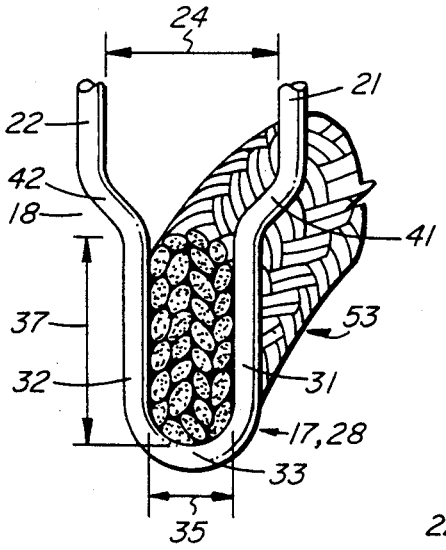
FIG. 5 is a simplified fragmented perspective view of a tip portion of the apparatus shown gripping a portion of a cover of the rope.
Figure 6:
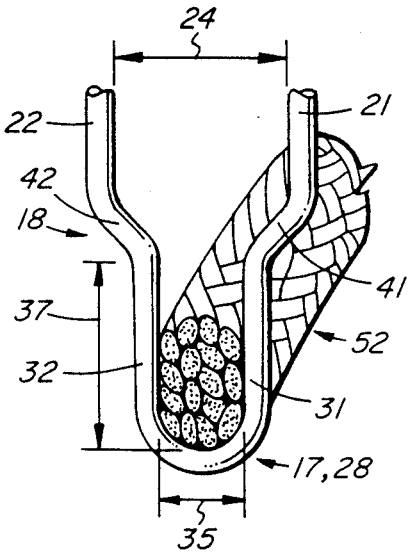
FIG. 6 is a simplified fragmented perspective view of the tip portion of the apparatus gripping a core of the rope.

Referring mainly to FIGS. 1, 5 and 6, an apparatus 10 according to the invention has a handle 12 and an elongated tool portion 14. The elongated tool portion comprises bent wire portions formed from a single piece of wire into three specific portions, namely a main portion 16, a tip portion 17, and a transitional portion 18. The main portion 16 comprises a pair of generally straight and parallel main rod portions 21 and 22 which are spaced apart at a main portion width 24 along length 25 of the main portion. The tip portion comprises a generally U-shaped rod portion 28 having two generally straight leg portions 31 and 32 connected through a bend portion 33. The leg portions are spaced apart at a tip portion width 35 which is narrower than the main portion width 24. The tip portion has a tip portion length 37 as measured between the transitional portion 18 and the bend portion 33.

Figure 2:
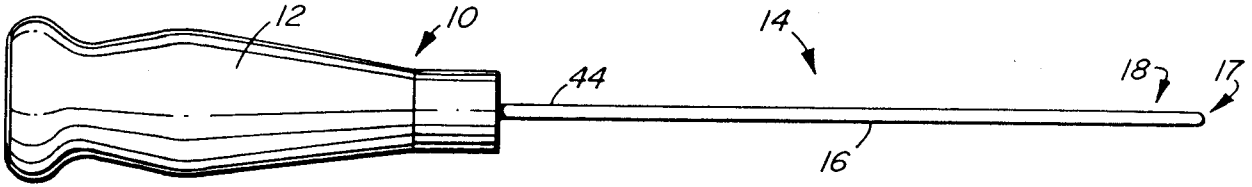
FIG. 2 is a side elevation of the apparatus of FIG. 1.

The transitional portion 18 comprises a pair of short rod portions 41 and 42 flaring outwardly from the leg portions 31 and 32 respectively of the tip portion to interconnect the main rod portions 21 and 22 with the leg portions 31 and 32 respectively. As seen in FIG. 2, the rod portions of the main portion 16, the tip portion 17, and the transitional portion 18 are all co-planar. The portions 16, 17 and 18 are formed from a single piece of bent wire and therefore have similar diameters and are smoothly connected together. It can be seen that the handle portion 12 is connected to a first end portion 44 of the main portion 16 remote from the tip portion 17.

The apparatus has an integral measuring scale or graduations incorporated therein to facilitate splicing a rope as will be described. In particular, the handle has first and second gauge positions 45 and 46, which are first and second gauge lengths measured from an outer end 43 of the handle. Distance between the end 43 and the first gauge position 45 is designated 45.1 in FIG. 1 and referred to as first handle gauge length in FIG. 3, at the fourth and fifth columns thereof. Distance between the outer end 43 and the second gauge position 46 is designated 46.1 in FIG. 1, and is referred to as the second handle gauge length in the fourth and fifth columns of FIG. 3. Clearly, the length 46.1 represents overall length of the handle. The main portion 16 has third, fourth and fifth gauge positions 48, 49 and 50, which, similarly to the first and second gauge positions, are used to provide different measurements for different rope diameters as follows. Distance between the end of the handle 43 and the third gauge position 48 is designated 48.1 in FIG. 1, and appears in the sixth and seventh columns of FIG. 3 as the third tool gauge length. Distance between the end of the handle 43 and the fourth gauge position 49 is designated 49.1 in FIG. 1, and appears in the sixth and seventh columns in FIG. 3 as the fourth tool gauge length. The distance between the end of the handle 43 and the fifth gauge position 50 is designated 50.1 in FIG. 1 and appears as the fifth tool gauge length in the sixth and seventh columns of FIG. 3. Clearly the spacing 50.1 between the outer end 43 and the gauge position 50 represents overall length 40 of the apparatus. The graduations on the main portion and the handle reflect length measurements dependent on rope size to mark a portion of the rope prior to splicing.

FIG. 3 shows a table of tool dimensions, and spacing of the graduations or gauge marks on the apparatus 10 from end of the handle with respect to size of a double or single braid rope to be formed into an eye splice using a method according to the invention. The specific dimensions shown can vary somewhat as in all matters relating to rope which is not susceptible to accurate measurement. The dimensions relating to diameter of the wire portions is selected to give the main portion 16 a resiliency which has been found to be sufficient when the apparatus is fabricated from a conventional stainless steel Preferably, limited resilience should be provided for the rod portions to enable the tip portion to grip the core or cover portion as will be described. However, the leg portions 21 and 22 should be sufficiently stiff to resist torque applied to the tip portion by rotating the handle back and forth, and to resist buckling when the tip portion 17 is initially forced between strands of a rope.

Figure 4:
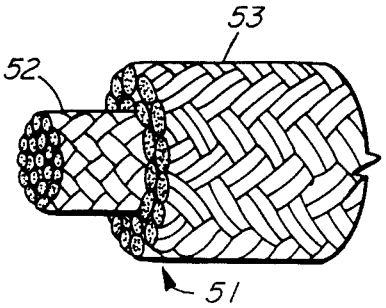
FIG. 4 is a simplified fragmented perspective view of an end of a dual braid rope showing a core and cover thereof.

In FIG. 4, a portion of dual braid rope 51 is shown having a hollow core 52 and a hollow cover 53, the cover being separable from and normally enclosing the core as shown. As is well known, the core and cover are both fabricated from a plurality of synthetic fibers or strands, or bundles of strands braided together to form respective flexible sheathes. The core and cover are usually relatively flexible so as to permit relative axial movement between the core and the cover as the rope passes around obstructions, which tends to partially flatten the rope.

Referring to FIG. 5, the dimensions of the tip portion 17 are determined by dimensions of the cover 53 when partially flattened as shown in FIG. 5. The tip portion width 35 is relatively narrow to facilitate insertion into the rope and also is adapted to grip the cover portion and also the core portion for splicing the rope. Preferably, the length 37 of the tip portion is approximately equal to overall width of the cover portion when partially flattened as shown in FIG. 5, that is the length 37 is approximately equal to one half of the circumference of the cover. When flattened, the cover 51 has a thickness which is approximately equal to the width 35 of the tool portion. There is sufficient resilience in the tool portion to permit slight opening of the leg portions 31 and 32 when the cover 4 portion is partially flattened and forced there between.

Referring to FIG. 6, the core 52 is similarly shown flattened and gripped between the leg portions 31 and 32 of the tip portion, although clearly, as the core is a smaller circumference than the cover, the flattened core has a thickness which is considerably less than the length 37 of the tip portion. As seen in the table of FIG. 3, a particular size of tool portion 14 can accommodate a relatively wide range of rope sizes, for example, for a particular tool size the maximum rope diameter is about 40–50% greater than the minimum rope diameter. Thus there is a wide variation between flattened thickness of a cover or core portion and the tip portion width, and flattened length of the cover or core portion and tip portion length.

One advantage of the tool of the invention is that the cover or core of the rope is gripped in the tip portion of the apparatus which requires that the flattened core or cover portion is tight fit in the tip portion. Clearly, considerable difficulty would be experienced in threading a rope or bundle of strands through an opening if the rope is deliberately designed to be a tight fit within the opening. This difficulty is increased if the ends of the rope are frayed as it would then be essentially impossible to force the ends of the rope through a tight fitting opening and would be similar to threading a needle with frayed thick thread.

The present invention eliminates the problem of threading rope through a tight fitting opening by providing an apparatus which has a relatively wide main portion 16 which is considerably wider than the core or cover of the rope. Thus, to simplify fitting the core or cover of the rope within the tip portion, the core or cover of the rope is first threaded through the relatively wide spacing 24 between the main rod portions 21 and 22, and is then pushed outwardly into the tip portion 17, so as to be gripped in the relatively narrower spacing 35 between the leg portions 31 and 32. Thus, even if the end of the rope is badly frayed, it can be easily threaded initially into the main portion 16, and then slid outwardly into the tip portion 17, being flattened by the tapering effect of the inclined short rod portions 41 and 42 of the transitional portion 18. This contrasts with the prior art method of whipping or taping an end of the rope to a fid, or threading it through a relatively tight fitting eye of a needle or other means.

Furthermore, it is important that the main rod portions 21 and 22 are spaced apart at the main portion width for the full length 25 of the main portion. That is, the first end portion 44 of the tool portion 14 is relatively wide where it joins the handle portion 12. This enables torque or an oscillating twisting force to be applied to the tool portion when initially inserting the tip portion 17 between strands of the rope. As the tip portion is gently pushed between the strands, the strands are gradually loosened by the outwardly tapering effect of the transitional portion 18 which facilitates entry of the larger width of the main portion 16. Clearly, twisting the handle slightly back and forth as the tip portion penetrates the rope gradually loosens the strands, and facilitates entry of the main portion into the rope. At this stage, the end portion of the cover or core is inserted through the main portion, pushed up into the tip portion and can then be drawn back through the gap between the strands of the rope. Clearly, the gap between the strands of the rope has already been made wider than the tip portion by the main portion of the rope, and thus can be sufficiently wide to receive the tip portion of the rope containing a flattened core or cover portion of the rope which is forced back on itself so as to be doubled when drawn through the rope by the apparatus.

Thus, the difference between the main portion width 24, and the tip portion width 35 is of major importance to this invention as it permits easy threading of the core or cover portion into the tool, and also facilitates widening the gap between the strands of the rope to permit pulling of the folded core or cover portion back through the rope. It has been found that a ratio of tip portion width 35 to main portion width 24 of about 1:1.4 to 1:1.9, and a ratio of tip portion width 35 to tip portion length 37 of about 1:1.2 to 1:1.8 is adequate for many applications. Clearly, in view of the wide variation in types of ropes, stiffness of the fibers and tightness of the braid, a wide variation from the above ratios would be necessary for certain applications. As will be disclosed in the method following, this threading and re-threading procedure occurs several times during the splicing of the rope and is a far quicker procedure than securing a rope portion to prior art fid. The invention also eliminates the use of two separate tools, which is a big advantage when splicing rope on a small vessel.

OPERATION

FIGS. 7 through 15. Method of forming an eye splice in a double braid rope

Figure 7:
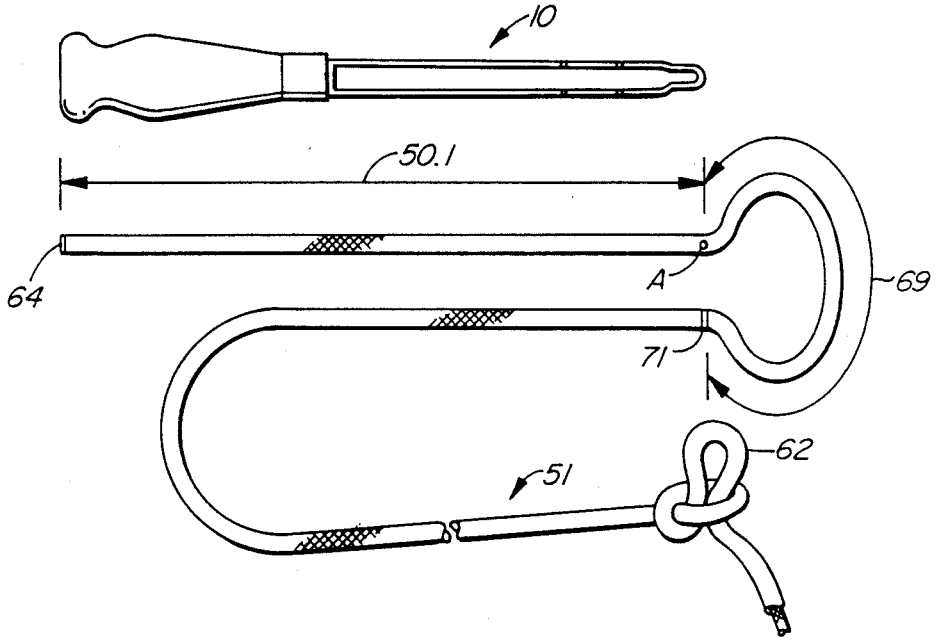
FIG. 7 shows a length of dual braid rope and one use of the apparatus to measure specific length of the rope prior to initiating the splice.

Referring to FIG. 7, prior to commencing to splice the rope 51, the rope is prepared as follows:

A length mark A is marked on the rope at a distance of one overall length of the apparatus, i.e. 50.1 from an adjacent end 64 of the rope. A variable eye length 69 is measured, in a direction away from the end 64 from the mark A to a first position 71 on the rope. The first position 71 determines the position of the throat of the eye, and the length 69 determines size of the eye. A knot 62 is then tied at a distance of about five times the overall length 50.1 of the apparatus 10 from the first position 71 of the rope. The knot 62 serves to anchor the core and cover together at a suitable distance from the end 64 of the rope to permit the splice to be adequately covered by the core when completed.

Figure 8:
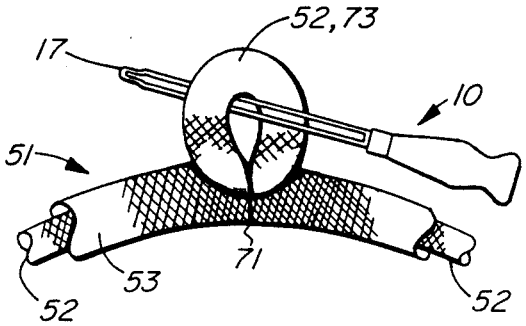
FIG. 8 shows initial extraction of a portion of the core from the rope.
Figure 9:
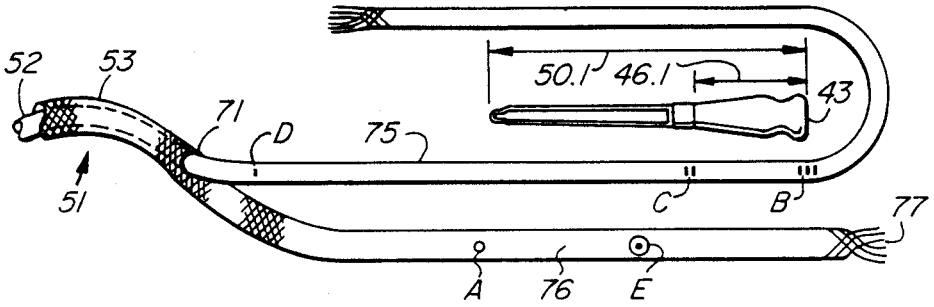
FIG. 9 shows a final extraction of a core end portion from a cover end portion of the rope, with various markings on the core and cover end portions necessary for performing the splice, a second use of the apparatus being shown.

Referring to FIGS. 8 and 9, the tip portion 17 of the apparatus 10 is inserted through the cover 53 of the rope at the first position 71 by inserting between adjacent strands to generate a first opening in the cover. As best seen in FIG. 8, the tool is forced or worked between an outside portion of the core 52 and an inside portion of the cover 53 so as to withdraw a portion of the core as a loop 73 through the first opening as shown. The loop 73 of the core is pulled completely through the opening so that the core and cover extend as a separate core end portion 75 and a cover end portion 76 from the first position 71 as seen in FIG. 9. While holding the exposed core end portion 75, push the remaining portion of the cover between the knot (62, FIG. 7) and the first position 71 backwards towards the knot and smooth the cover back towards the exposed core end. The next step is to mark the rope to ensure that adequate lengths of the core and cover end portion are cooperating with each other to provide a strong eye splice. For the initial marking, the core end portion and cover end portion have been smoothed so that they are approximately the same length extending from the first position 71, which configuration is not shown. In this condition, where the core 52 exits the cover at the position 71, the core is marked with a mark B. Then, the core end portion is pulled out from the first position 71 so that the core end portion becomes approximately twice as long as the cover end portion as shown in FIG. 9. Then, by placing the apparatus 10 as shown with the end 43 of the handle adjacent the mark B, the core end portion is marked with another mark C at a handle gauge length, e.g. 46.1, from the mark B, and marked with another mark D at a distance (50.1 plus 46.1) from mark C. The handle gauge length in FIG. 9 is shown to be for the second handle gauge, i.e. 46.1, although clearly if the thinnest rope of a particular set of ropes were being used, the first handle gauge position or length 45.1 would be substituted to produce a correspondingly shorter length.

Following normal practice, at least a portion of the cover end portion 76 is tapered for a smooth splice, and for this a mark E is marked on the cover end portion at a distance of about eight strand pairs from the mark A towards an outer end 77 of the end portion.

Figure 10:
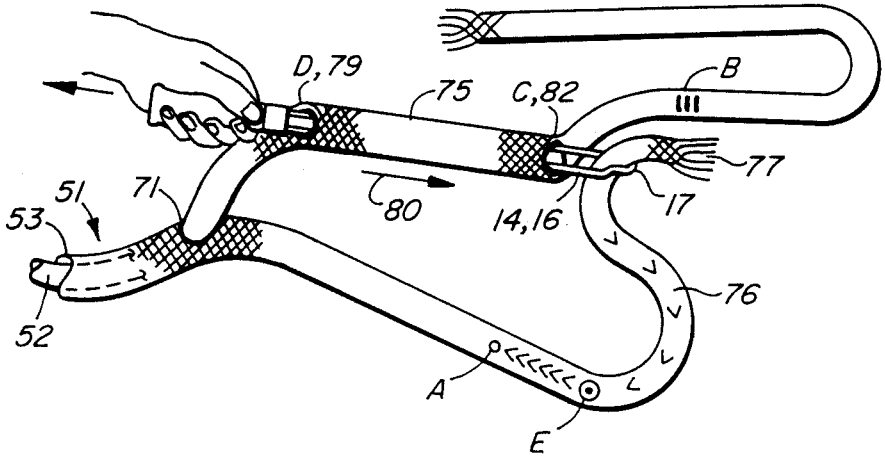
FIG. 10 shows the apparatus threaded through the core end portion of the rope prior to drawing the cover end portion through the rope.

Referring to FIG. 10, the tip portion 17 of the apparatus is inserted into the core end portion 75 at the mark D which defines a second position 79 on the core end portion which is closely adjacent the first position 71. The tool portion 14 is fed axially along the core end portion in a direction 80 away from the first position 71 so that a length of the tool portion lies inside the core end portion 75. The tip portion 17 of the cover portion is then extended outwardly from the core end portion 75 at the mark C which defines a third position 82 on the core end portion. The cover end portion 76 of the rope is then threaded through the tool portion 14, and gripped with the tip portion 17 by sliding the cover end portion into the tip portion. Clearly, as before described, especially if the ends of the cover end portion are frayed, it is easier to thread the cover end portion through the relatively wide space between the legs of the main portion 16, and then slide the cover end portion towards the tip portion wherein the strands of the cover end portion are then gripped between the legs of the tip portion. When the cover end portion is so gripped in the tip portion, the tool portion together with the cover end portion is withdrawn through the rope.

Figure 11:
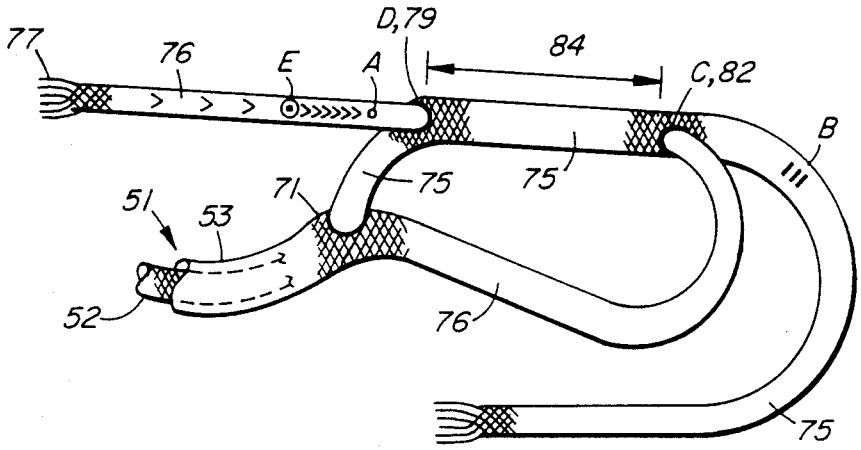
FIG. 11 shows a portion of the cover end portion drawn through the core end portion of the rope, prior to cutting and tapering of the cover.

Referring to FIG. 11, withdrawing the tool portion and cover end portion backwardly through the openings in the core end portion draws a length of the cover end portion in through the third position 82, and out from the second position 79 of the core end portion until point A on the cover end portion 76 passes the second position 79 on the core. This determines the desired size of eye as determined by the location of point A and the first position 71. It can be seen that a first length 84 of the cover end portion extends within the core end portion 75 between the third and second positions 82 and 79 respectively. The cover end portion is then separated from the tool portion. Following common practice, every fifth strand of the cover, either paired or single, from the mark E to the end 77 is then cut and tapered so that when the rope is put under load, the tapered portion of the cover will mostly disappear inside the rope. Any length of the tapered end projecting from the rope is cut off.

If the eye splice is relatively large, that is, its circumference is several times the length of the tool portion 14, the core is threaded through the cover in two stages to be described first. With a relatively small eye splice, i.e. its circumference is less than twice the length of the tool portion 14, the core is threaded through the cover in one stage as will be described later.

Figure 12:
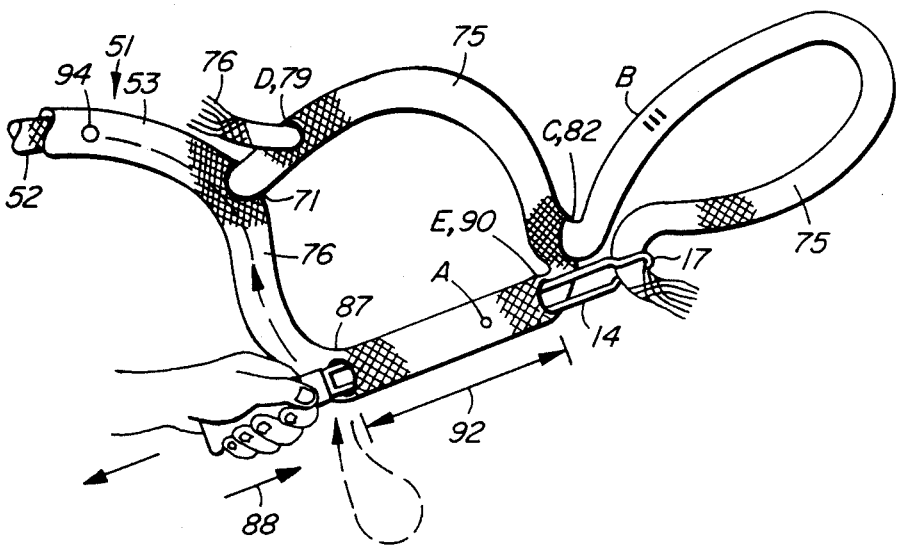
FIG. 12 shows the apparatus threaded through the cover end portion prior to drawing the core end portion through the cover end portion.

Referring to FIG. 12, to initiate threading the core through the cover, the tip portion 17 is inserted into the cover end portion 76 at a fourth position 87 which is spaced between the point where the cover end portion 76 exits the core end portion 75 at the position 82 and the first position 71. The tool portion is fed axially through the cover end portion 76 in a direction 88 away from the first position 71 so that a length of tool portion lies inside the cover end portion. The tip portion 17 is then extended outwardly from the cover end portion 76 at the mark E, which defines a fifth position 90 on the cover end portion 76 which is closely adjacent the third position 82 on the core end portion. The core end portion 75 is then threaded through the tool portion 14 and gripped with the tip portion 17 in the same manner as described with reference to gripping the cover end portion. The tool portion and the core end portion are then withdrawn backwardly through the cover end portion so as to draw a second length 92 of the core end portion in through the fifth portion 90 and out through the fourth portion 87 of the cover end portion. In this condition, which is also shown partly in FIG. 13, the first length 92 of core end portion 75 extends within the cover end portion from the fifth position 90 to the fourth position 87. The core end portion is then separated from the tool portion as before.

To complete the threading of the core end portion 75 within the remaining section of the cover end portion 76 and the rope 51, the tip portion 17 is inserted into a sixth position 94 on the cover 53 of the complete rope on the side of the eye or first position 71 remote from the second and fourth positions 79 and 87 respectively. This step is not shown and is similar to the step used with a small eye splice. The tool portion is fed axially along the complete rope portion 51 and between the core and cover in a direction away from the sixth position 94 and towards and past the first position 71, and into the cover end portion 76. The tip portion 17 is then extended outwardly from the cover end portion at the fourth position 87. It is important that the tip portion 17 passes through exactly the same opening in the cover end portion at the fourth position 87 as the core end portion. At the fourth position, the core end portion 76 is again threaded through the tool portion and gripped with the tip portion.

Figure 13:
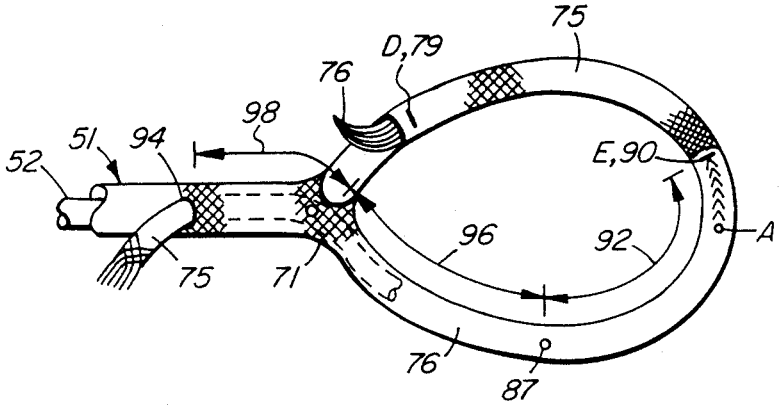
FIG. 13 shows a partially formed eye splice and also shows the core end portion after cutting and tapering.

Referring to FIG. 13, initially the tool portion (not shown) and core end portion 75 are then drawn backwardly through the fourth position 87 and into the cover end portion 76, past the first position 71 and outwardly of the rope at the sixth position 94 so that an outer end of the core end portion 75 extends freely from the rope. In this way, a third length 96 of the core end portion 75 extends within the cover end portion from the fourth position 87 to the first position 71, and a fourth length 98 of core portion extends within the rope 51 between the core and the cover the main rope from the first position 71 to the sixth position 94. As before, the core end portion extending from the position 94 is separated from the tool portion.

After smoothing the core end portion with respect to the eye portion, the core end portion is then marked at a position where it exits from the sixth position 94. The core end portion is then pulled further outwardly from the rope, and portions of the core end portion are then cut and tapered as is common practice, so as to smooth the core where it joins the rope. Then, following normal practice, portions of the rope are stroked as required to smooth the core end portions into the main portion of the rope.

Figure 14:
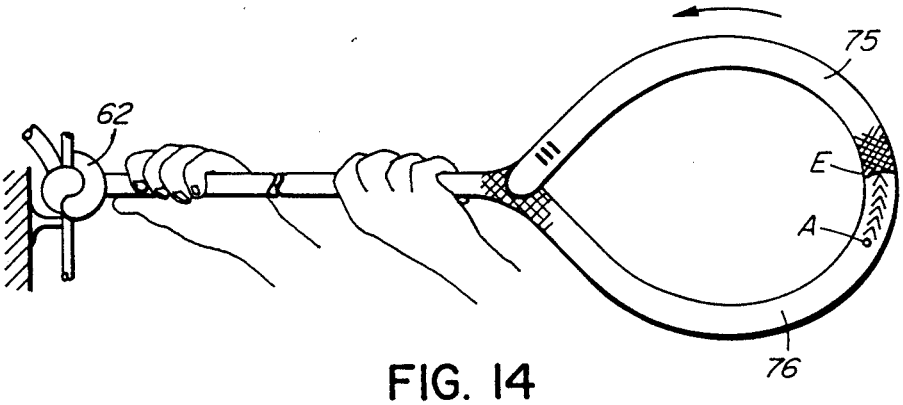
FIG. 14 shows stroking of the cover towards the eye splice.

Referring to FIG. 14, the knot 62 is anchored to a fixed portion, and the hands then grip the rope to stroke or "milk" the cover 53 towards the eye by sliding the cover along the core with the hands as shown. After sufficient stroking of the cover, the core end portion 75 extending between the first position 71 and the position A should be drawn in to the main portion of the rope through the first position 71. In this way, mark A eventually is drawn into the first position 71, reducing the final size of the eye to approximately one half of that shown in FIG. 14. This "stroking" is common practice with prior art splicing methods and further detailed description is deemed unnecessary.

Figure 15:
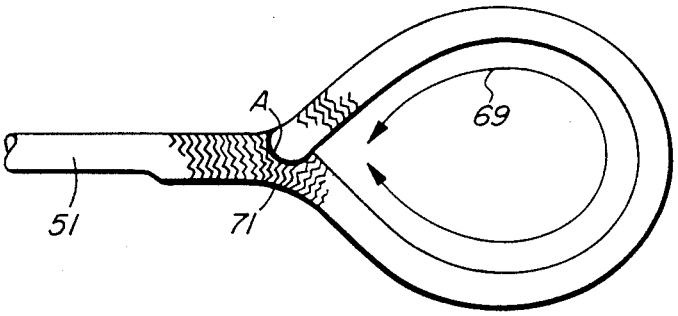
FIG. 15 shows final stroking and the finished eye splice.

Referring to FIG. 15, the resulting eye is a smaller diameter than the eye in FIG. 14, and the cover 53 has been "milked" until the mark A on the cover is buried under the cover of the main rope, and is smoothed to eliminate any bunching or congestion from the mark E to the first position 71.

The resulting eye splice produced by the method described above resembles closely the eye splice shown in U.S. Pat. No. 4,099,750. Clearly, the relative movements and threading between the core end portion and the cover end portion are similar, and relative dimensional spacing between the various positions on the rope are also similar to those described in the patent and practiced in prior art splicing methods. The major difference from the prior art method results from the shape of the splicing tool which requires that the tool be first pushed through a rope portion and the tool is then threaded with the appropriate cover or core end portion prior to drawing the cover or core end portion backwards through the rope portion. This eliminates the splicing or whipping of the strands of the rope to the prior art fid and which is usually followed by pushing the fid with a separate tool through the strands of the rope.

The description above relates to forming a relatively large eye splice. For a relatively small eye splice, the main portion of the tool has sufficient length to permit the core end portion to be threaded through the cover end portion from the fifth position 90 to the sixth position 94 in one pass, as opposed to the two passes as described using the fourth position 87 as an intermediate threading stage. Thus, an alternative means of completing the eye splice would be appropriate to eye splices having a half circumference which is considerably less than the main portion length 25 of the tool. Consequently, for the smaller eye splice, the fourth position 87 on the cover is not required as an intermediate position. Instead the tip portion 17 is inserted into the rope at the sixth position 94, is then threaded between the cover and core of the rope past the first position 71, so as to extend through the cover portion at the fifth position 90. The core end portion 75 is then threaded through the tool and gripped by the tip portion 17, and the tool and core end portion are then withdrawn from the rope so as to draw the core end portion in through the fifth position 90, and out through the sixth position 94. In this way, the core end portion will lie within the cover end portion from the fifth position 90 to the sixth position 94 and thus will resemble exactly that of the previous description. Thus there is no difference in the final product except with respect to the size of the eye, and thus the two methods are equivalent.

ALTERNATIVES

The above method relates to forming a double braid rope with an eye splice which resembles a prior art eye splice in a double braid rope. It is known to form eye splices in a single hollow braid rope, and the brief description following relates to one such method which results in an eye splice which also resembles prior art eye splices. Again, the method of forming the eye splice differs from the prior art method by first inserting the tool through the rope, threading the tool with the appropriate rope portion, and then withdrawing the rope portion backwards through the rope.

Figure 16:
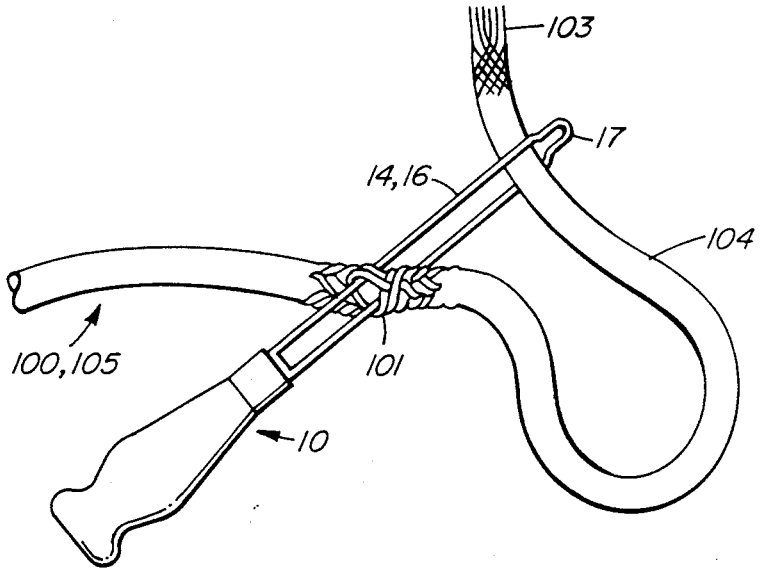
FIG. 16 shows an initial stage of splicing a single braid rope with an apparatus according the invention.
Figure 17:
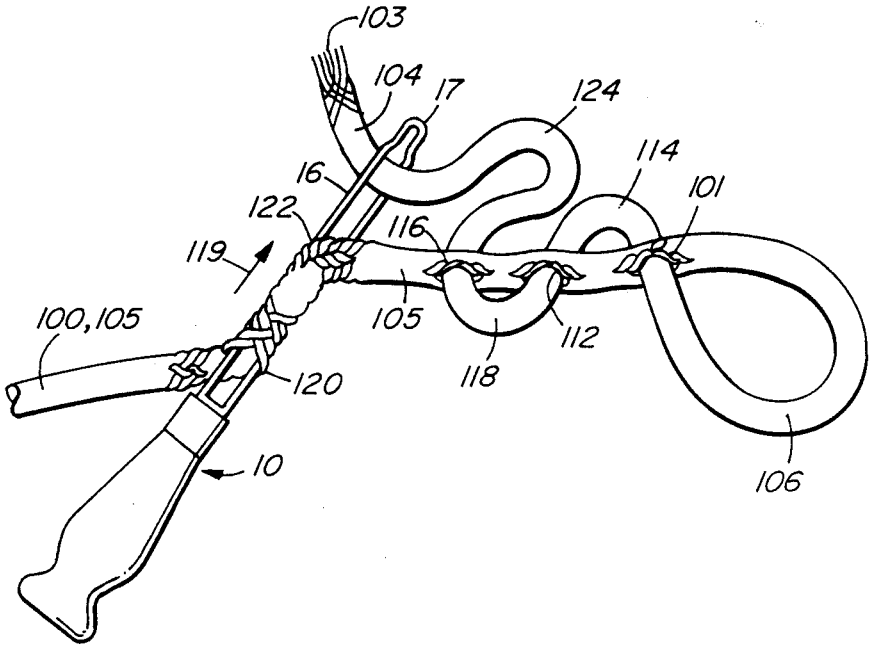
FIG. 17 shows a final stage of splicing a single braid rope with an apparatus according to the invention.

FIGS. 16 and 17. Method of forming an eye splice in a single braid rope

An eye splice is to be formed in a length 100 of single hollow braid rope using the apparatus 10 according to the invention. Preferably, the rope is marked as previously described to indicate specific locations on the rope, although with experience a skilled operator can estimate fairly closely without first marking the rope.

Referring to FIG. 16, the tip portion is inserted through a first position 101 on the rope spaced from an adjacent end 103, the position 101 determining location of the throat position of the eye splice. A portion 104 of the rope extending from the position, 101 to the end of 103 is termed an end portion of the rope, and is selected to provide an eye of suitable size with sufficient overlap with a main portion 105 of the rope. The tip portion 17 is pushed to extend outwardly from the rope as shown, and the end portion 104 of the rope is threaded through the tool portion 14 and gripped with the tip portion 17. The tool portion 14 and end portion 104 of the rope are then withdrawn backwardly through the first position 101 of the rope, thus drawing the end portion 104 of the rope through the first position 101 of the rope to form a desired size of eye 106, as seen in FIG. 17, extending from the main portion 105 of the rope. The end portion 104 of the rope is separated from the tool portion as before.

Referring to FIG. 17, the tip portion 17 is then inserted sequentially through several positions of the rope, each insertion being followed by drawing an end portion of the rope through the main rope, the number of positions being determined from the actual load that the rope is to be subjected to. In FIG. 17, the tool portion is shown passing through the rope in a final stage of the splice, the intermediate stages of the method not being illustrated, but they will be briefly described as follows.

After first forming the eye 106, the tool is passed through a second position 112 on the main portion 105 of the rope, the second position being spaced from the first position 101 and on a side thereof remote from the eye 106. The tip portion extends outwardly from the rope and the end portion of the rope is again threaded through the tool portion and gripped with the tip portion. The tool portion and the end portion of the rope are again withdrawn backwardly through the second position 112 on the rope. The end portion of the rope is drawn through the second position 112 of the rope until a first length 114 of the end portion 104 of the rope extends generally parallel to the main rope 105 and outside the main rope extending from the first postion 101 to the second position 112. FIG. 17 is shown with the end portion 104 loosely threaded in an intermediate position prior to tensioning the end portion of the rope as it passes through the openings in the main rope, and thus the first length 114 is not shown parallel to the main portion of the rope.

The tip portion of the tool is then inserted into a third position 116 on the main portion 105 of the rope and the procedure repeated so that a second length of rope 118 extends from the second position 112 to the third position 116. Again, in FIG. 17 the second length of rope 118 is shown in a loose condition extending between the positions 112 and 116 prior to tightening.

As specifically shown in FIG. 17, the tip portion 17 is then inserted into a fourth position 120 of the main rope, the fourth position 120 being spaced from the third position on a side thereof remote from the first and second positions. The tool portion is fed axially along and within the rope in a direction 119 generally towards the first and second positions 112 and 116, the direction being designated as if the rope were straight. The rope is shown bent in FIG. 17, as it would be in practice, as the tip portion can then be extended outwardly from the rope through a fifth position 122 spaced along the rope from the fourth position 120 towards the third position 116. In this condition as shown, a length of the tool portion lies within a section of the main rope 105 between the fourth and fifth positions 120 and 122 respectively. The end portion of the rope is then threaded through the tool portion and gripped with the tip portion as previously described, and as partially shown in FIG. 17.

The tool portion and the end portion of the rope are then withdrawn backwardly through the fifth position 122 and into and axially along the main portion 105 of the rope and then outwardly of the rope at the fourth position 120. In this way, the end portion 104 of the rope is withdrawn completely through the main portion 105 and extends from the fifth position 122, and a third length of rope 124 extends between the third position 116 of the rope and the fifth position 122. All remaining slack within the end portion of the rope is removed so that lengths 114, 118 and 124 of the rope extending externally between positions 101, 112, 116 and 122 on the main rope are relatively snug against the main portion of the rope 105. This is followed by separating the end portion of the rope from the tool portion. At this stage a fourth remaining length of rope extends generally parallel to the main rope portion and inside the main rope portion from the fifth position 122 to the fourth position 120. While this is not illustrated, it can be clearly discerned from FIG. 17 and the resulting structure closely resembles a known prior art eye splice. The end portion 104 of the rope is then cut to length and tapered if necessary closely adjacent the fourth position, and portions of the rope adjacent the eye splice are stroked as required to smooth the end portions of the rope into the adjacent main portion of the rope.

The method disclosed above would be for high load applications in which three lengths of rope 114, 118 and 124 extend externally between the four positions 101, 112, 116 and 122 of the rope, the end portion passing internally of the rope between the fifth and fourth positions 122 and 120 to extend along the rope and out through the fifth position. As is well known in the trade, the last portion of rope extending from the fourth position to the fifth position can be eliminated so that only a third remaining length of rope would extend generally parallel to the main rope portion and inside the main rope portion from the fourth position to the third position. While this is not illustrated, it would be clearly possible from the figures and common practice to eliminate the third portion of rope extending outside the main rope as described.

Figure 18:
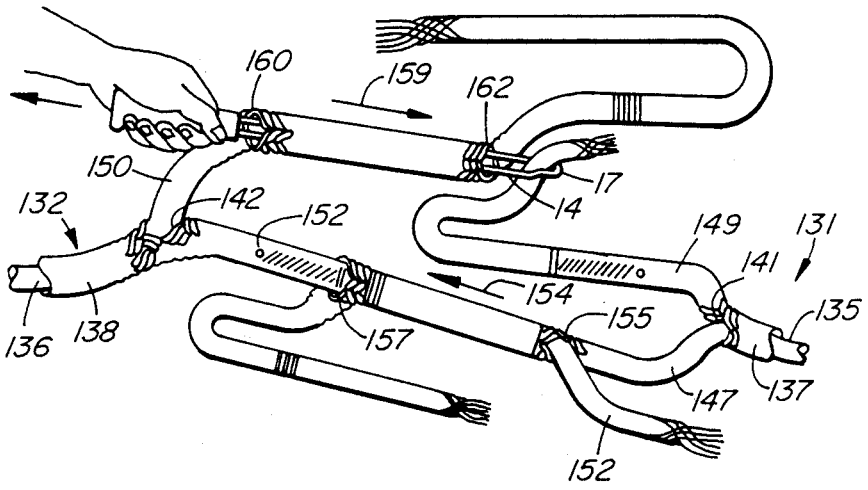
FIG. 18 shows an intermediate stage of splicing together two separate pieces of dual braid rope using the apparatus according to the invention to form a marriage splice.
Figure 19:
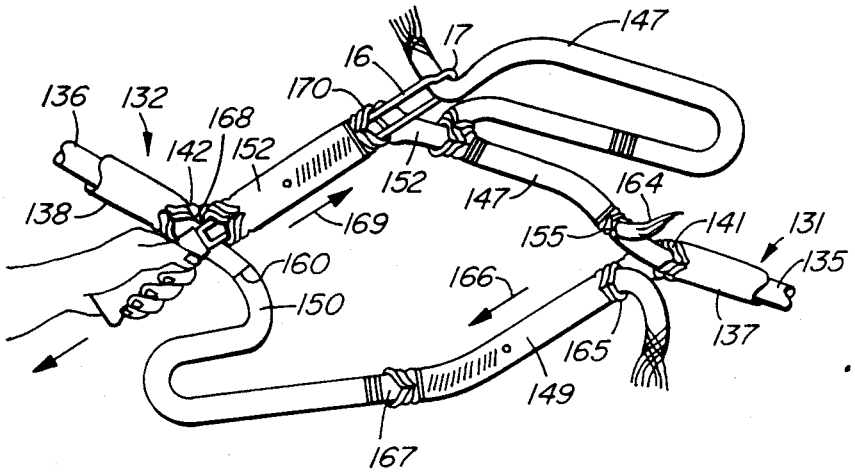
FIG. 19 shows a later stage of forming the marriage splice.

FIGS. 18 and 19. Method of forming a marriage splice in two dual braid ropes The present apparatus also simplifies considerably forming a marriage splice in dual braid or single braid ropes. Much of the procedure described for forming the eye splice in a dual braid or single braid rope follows similarly for the marriage splice. Consequently, the description of the marriage splice is simplified considerably as an understanding of the method of the invention for forming an eye splice can be applied when forming a marriage splice. Many steps, e.g. marking of the rope, are not described in detail as they follow from the previously described method, or the prior art.

The method according to the invention is for splicing together by means of a marriage splice first and second dual braid ropes 131 and 132 using the tool of the invention. First and second ropes 131 and 132 have respective first and second hollow cores 135 and 136 which are enclosed by respective first and second hollow covers 137 and 138. The initial preparation for separation of the rope end portions is not shown or described in detail as it follows closely the initial preparation of a dual braid rope for an eye splice. In the marriage splice, the tip portion 17 of the tool portion 14 is inserted through the covers 137 and 138 of each rope at respective first positions 141 and 142 of each rope, which are spaced from adjacent ends 145 and 146 respectively of each rope. The tip portion thus generates respective first openings in the respective covers so as to determine a junction of the marriage splice for each rope. As in the eye splice, the method includes withdrawing a portion of the core 135 and 136 through the respective first opening in the respective covers so that a separate first core end portion 147 and a first cover end portion 149 extend from the first position 141 of the rope 131, and a separate second core end portion 150 and a second cover end portion 152 extend from the first position 142 of the second rope. The respective cover and core end portions are shown in FIG. 18.

The method continues with a step which is also not shown in FIG. 18 which includes inserting the tip portion of the tool portion into the first core end portion 147 at a second position 155 closely adjacent the first position 141. The tool portion is fed axially along the core end portion 147 in a direction 154 away from the first position 141 so that a length of the tool portion lies inside the core end portion 147. The tip portion of the tool portion is then extended outwardly from the core end portion at a third position 157 on the first core end portion. The second cover end portion 152 is threaded through the tool portion and gripped therein with the tip portion, as previously described. The method includes withdrawing the tool portion and the second cover end portion 152 backwardly through the core end portion 147 of the first rope. This draws a length of the second cover end portion in through the third position 157 of the first rope and out from the second position 155 of the first core end portion and is followed by separating the cover end portion 152 from the tool portion.

The result of the above method step is shown generally in FIG. 18, which also illustrates an intermediate stage of the next method step which is generally parallel to the previous method step but with the rope positions reversed. Thus, the method step shown partially in FIG. 18 includes inserting the tip-portion of the tool portion in to the second core end portion 150 at a second position 160 closely adjacent the first position 142. The tool portion is then fed axially along the core end portion 150 in a direction 159 away from the first position 142 so that a length of the tool portion lies inside the core end portion 150. The tip portion of the tool is extended outwardly from the core end portion 150 at a third position 162 on the first core end portion. As before, the first cover end portion 149 of the first rope 131 is threaded through the tool portion and gripped with the tip portion thereof which condition is specificially shown in FIG. 18.

The method is then followed by withdrawing the tool portion and the first cover end portion 149 backwardly through the core end portion 150 of the second rope so as to draw a length of the first cover end portion 149 in through the third position 162 of the second rope and out from the second position 155 of the second core end portion. This is followed by separating the first cover end portion 149 from the tool portion. At this stage, the first and second cover end portions 149 and 150 are cut to length closely adjacent the second position of the respective second and first core end portions 150 and 147 respectively and tapered, if necessary, as is common practice.

Referring to FIG. 19, (in which relative positions of the end portions are reversed) a trimmed end 164 of the cover end portion 152 is shown about to disappear into the opening at the second position 155 of the first core end portion 147. However, the corresponding tapered end of the first cover end portion 149 has been already withdrawn into the opening at the second position 160 of the second core end portion 150. The tapered cover end portions are withdrawn out of sight into respective openings following stroking portions of the core and cover adjacent the respective second positions as required, so as to smooth the cover end portion into the adjacent portion of the core end portion.

The next step of the process in not illustrated in FIG. 19, and relates to inserting the tip portion 17 of the tool portion 16 in to the first cover end portion 149 at a fourth position 165 adjacent the first position 141, feeding the tool portion axially along the cover end portion 149 in a direction 166 away from the first position 141 so that a length of tool portion lies inside the cover end portion 149. This is followed by extending the tip portion of the tool portion outwardly from the cover end portion at a fifth position 167 on the cover end portion 149. The core end portion 150 of the second rope is passed through the tool portion and gripped with the tip portion thereof This is followed by withdrawing the tool portion and the core end portion 150 backwardly through the cover end portion 149 so as to draw a length of the core end portion 150 in through the fifth position 167 and out through the fourth position 165 of the first cover end portion 149. Thus a first length of the core end portion 150 extends within the cover end portion from the fifth position to the fourth position 165. Afterwards the core end portion 150 is separated from the tool portion and only an.-extreme portion of the core end portion extends through the opening at the fourth position 165.

Referring now to FIG. 19, the parallel step of the above process steps is illustrated in part, and shows withdrawing the core end portion 147 of the first rope through the cover end portion 152 of the second rope as follows. This portion of the method includes inserting the tip portion of the tool portion into the cover end portion 152 at a fourth position 168 adjacent the first position 142, followed by feeding the tool portion axially along the second cover end portion in a direction 169 away from the first position 142 so that a length of the tool portion lies inside the second cover end portion. This is followed by extending the tip portion 17 of the tool portion 14 outwardly from the second cover end portion 152 at a fifth position 170 on the second cover end portion. As before, the method includes threading the core end portion 147 of the first rope 131 through the tool portion and gripping the core end portion with the tip portion This is the condition of the method step as shown in FIG. 19, and is followed by withdrawing the tool portion and the core end portion 147 backwardly through the cover end portion 152 so as to draw a length of the core end portion 147 in through the fifth position 170 and out through the fourth position 168 of the second cover end portion. Thus, a first length of the first core end portion extends within the second cover end portion from the fifth position 170 to the fourth position 168 thereof. This is then followed by separating the core end portion from the tool portion.

At this stage, the core end portions are smoothed so as to extend through the openings through the respective fourth positions of the ropes, and are then cut to length and tapered, followed by stroking portions of the rope as required to smooth the core end portions in to the cover end portions. Then as before, the covers are slid along the respective cores towards the middle of the splice so as to smooth the core end portions into the respective cover end portions as is well known in the trade.

Figure 20:
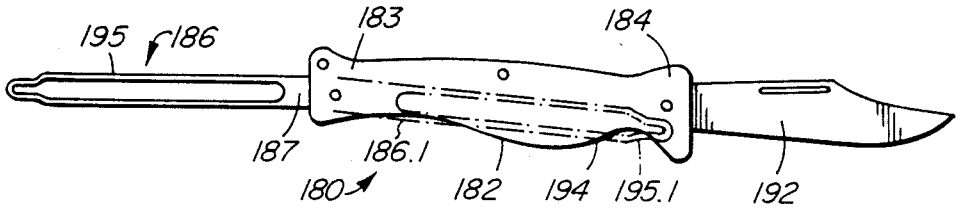
FIG. 20 is a side elevation of an alternative embodiment of the invention in which the tool portion of the apparatus is combined with a folding knife blade.
Figure 21:
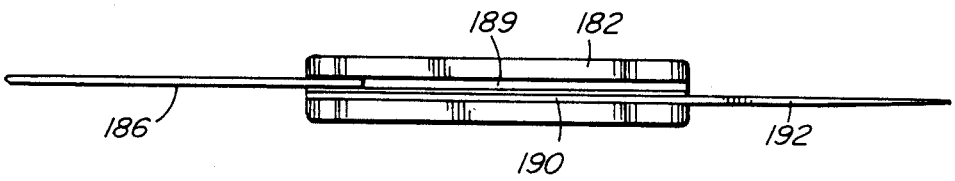
FIG. 21 is a top plan of the embodiment of FIG. 20.

FIGS. 20 and 21. Alternative apparatus

An alternative embodiment 180 of the apparatus has a handle portion 182 having first and second end portions 183 and 184 respectively. An elongated tool portion 186 according to the invention has a first end portion 187 hinged to the first end portion 183 of the handle for swinging thereabouts. The handle portion 182 has first and second axial slits 189 and 190 extending between the first and second ends thereof. The elongated tool portion 186 is hinged within the first slit 189, and has a length sufficient to be received within the slit 189 when swung through about 180° from the position shown. A knife blade 192 is hinged to the second end portion 184 of the handle 184 within the second axial slit 190. As in a conventional folding knife, the blade has a length to be received within the slit 190. Thus, when both the elongated tool portion 186 and the blade 192 are swung relative to the handle to assume a folded condition in the handle, outer ends of the tool portion 186 and knife are received within these slits and do not project axially from the handle. Thus, in the folded condition, the alternative apparatus 180 closely resembles a folding knife having two blades hinged from opposite ends thereof.

Preferably, the second end portion 184 of the handle has a recessed edge portion 194 which extends inwardly in to the handle as shown. In this way, when the tool portion 186 assumes a folded position 186.1, (broken outline) the recessed edge portion 194 provides a space sufficient to permit insertion of a thumbnail or other thin object under an outer main rod portion 195 of the portion 186, the rod portion being shown as 195.1. This permits the tool portion 186 to be easily gripped by the nail and swung outwardly from the retracted or folded position shown in broken outline.

The apparatus and methods described above are examples of the invention, which is capable of expression in apparatus and methods other than those particularly described and illustrated.

I claim:

1. A rope splicing apparatus having an elongated tool portion which includes:

(a) a main portion comprising a pair of generally straight and parallel main rod portions which are spaced apart at an essentially constant main portion width for the complete length of the main portion, (b) a tip portion comprising a generally U-shaped rod portion having two generally straight leg portions connected through a bend portion, the leg portions being spaced apart at a tip portion width which is narrower than the main portion width, (c) a transitional portion comprising a pair of short rod portions flaring outwardly from the leg portions of the tip portion to interconnect the main portions with the leg portions, (d) the rod portions of the main portion, the transitional portion and the tip portion being co-planar.

2. An apparatus as claimed in claim 1, further, including:

(a) a handle portion connected to a first end portion of the main portion remote from the tip portion.

3. An apparatus as claimed in claim 2, in which:

(a) the first end portion of the main portion is hinged to a first end portion of the handle portion for swinging thereabouts.

4. An apparatus as claimed in claim 3, further including:

(a) a knife blade, and in which:

(b) the handle portion has a second end portion with the knife blade hinged thereto for swinging thereabouts.

5. An apparatus as claimed in claim 1, in which:

(a) the rod portions of the main portion, the transitional portion and the tip portion comprise bent wire rod portions of similar diameters connected smoothly together.

6. An apparatus as claimed in claim 1, in which:

(a) the main portion has graduations thereon to reflect length measurements dependent on rope size to mark a portion of the rope prior to splicing.

7. An apparatus as claimed in claim 1 in which: (a) ratio of the tip portion width to the main portion width is between about 1:1.4 and 1:1.9.

8. An apparatus as claimed in claim 1 in which:

(a) the tip portion has a tip portion length as measured between the transitional portion and the bend portion, (b) ratio of the tip portion width to the tip portion length is between about 1:1.2 and 1:1.8.

9. An apparatus as claimed in claim 1, in which:

(a) the leg portions of the tip portion are generally parallel to each other so that the tip portion width is essentially constant along the length of the said leg portions.

10. A method of eye splicing a dual braid rope by using an elongated tool portion having a tip portion, the rope having a hollow core and a hollow cover, the cover normally enclosing the core, the method including the steps of:

(a) inserting the tip portion of the tool through the cover of the rope at a first position on the rope spaced from an adjacent end of the rope to generate a first opening in the cover and to determine a throat position of the eye splice, (b) withdrawing a portion of the core extending to the adjacent end of the rope through the first opening in the cover so that the core and cover extend as a separate core end portion and a cover end portion from the first position, (c) inserting the tip portion of the tool portion into the core end portion at a second position closely adjacent the first position, feeding the tool portion axially along the core end portion in a direction away from the first position so that a length of the tool portion lies inside the core end portion, and extending the tip portion of the tool portion outwardly from the core end portion at a third position on the core end portion, (d) threading the cover end portion of the rope through the tool portion and gripping the cover end portion of the rope with the tip portion, (e) withdrawing the tool portion and the cover end portion backwardly through the core end portion so as to draw a length of the cover end portion in through the third position and out from the second position of the core end portion until a desired size of eye is attained so that a first length of the cover end portion extends within the core end portion between the third and second positions, and separating the cover end portion from the tool portion, (f) cutting the cover end portion to length closely adjacent the second position of the core and stroking portions of the core and cover adjacent the second position as required to smooth the cover end portion into the adjacent portion of the core end portion, (g) inserting the tip portion of the tool portion into the cover end portion at a fourth position generally adjacent the first position, feeding the tool portion axially along the cover end portion in a direction away from the first position so that a length of tool portion lies inside the cover end portion, and extending the tip portion of the tool portion outwardly from the cover end portion at a fifth position on the cover end portion, (h) threading the core end portion through the tool portion and gripping the core end portion with the tip portion, (i) withdrawing the tool portion and the core end portion backwardly through the cover end portion so as to draw a length of the core end portion in through the fifth position and out through the fourth position of the cover end portion so that a first length of core end portion extends within the cover end portion from the fifth position to the fourth position, and separating the core end portion from the tool portion, (j) inserting the tip portion into a sixth position on the cover on a side of the eye remote from the second and fourth positions, feeding the tool portion axially along the rope portion between the core and the cover in a direction away from the sixth position and towards and past the first position of the cover end portion, and extending the tip portion of the tool outwardly from the cover end portion at the fourth position, (k) threading the core end portion through the tool portion and gripping the core end portion with the tip portion, (l) withdrawing the tool portion and the core end portion backwardly through the fourth position, past the first position and outwardly of the sixth position so that a third length of the core end portion extends within the cover end portion from the fourth to the first position, and a fourth length of core end portion extends between the core and the cover of the main rope from the first position to the sixth position, and separating the core end portion from the tool portion, (m) cutting the core end portion to length adjacent the sixth position and stroking portions of the rope as required to smooth the core end portion into the main portion of the rope.

11. A method of eye splicing a single hollow braid rope by using an elongated tool portion having a tip portion, the method including the steps of:

(a) inserting the tip portion through a first position on the rope spaced from an adjacent end of the rope, to determine a throat position of the eye splice, the tip portion extending outwardly from the rope, (b) threading an end portion of the rope through the tool portion and gripping the end portion of the rope with the tip portion, (c) withdrawing the tool portion and the end portion of the rope backwardly through the first position of the rope, and drawing the end portion of the rope through the first position of the rope to form a desired size of eye which now extends from a main portion of the rope, and separating the end portion of the rope from the tool portion, (d) inserting the tip portion through a second position on the main portion of the rope, the second position being spaced from the first position and on a side thereof remote from the eye, the tip portion extending outwardly from the main portion of the rope, (e) threading the end portion of the rope through the tool portion and gripping the end portion of the rope with the tip portion, (f) withdrawing the tool portion and the end portion of the rope backwardly through the second position of the main portion of the rope and drawing the end portion of the rope through the second position of the main portion until a first remaining length of rope extends generally parallel to the main portion of the rope and outside the main portion from the first position to the second position, (g) inserting the tip portion into a third position of the main rope, the third position being spaced from the second position and on a side thereof remote from the first position, and feeding the tool portion axially along and within the rope in a direction generally towards the first and second positions, (h) extending the tip portion outwardly from the rope through a fourth position spaced along the rope from the third position towards the second position so that a length of the tool portion lies within a section of the main rope between the third and fourth positions, (i) threading the end portion of the rope through the tool portion and gripping the end portion with the tip portion, (j) withdrawing the tool portion and the end portion of the rope backwardly through the fourth position and into and axially along the rope, and then outwardly of the rope at the third position so that the end portion of the rope is withdrawn completely through and extends from the fourth position, and separating the end portion of the rope from the tool portion, so that a second remaining length of rope extends generally parallel to the main rope outside the main rope from the second position to the third position and a third remaining length of rope extends generally parallel to the main rope portion and inside the main rope from the fourth position to the third position, (k) cutting the end portion of the rope to length closely adjacent the third position and stroking portions of the rope as required to smooth the end portion of the rope into the adjacent main portion of the rope.

12. A method of splicing together by means of a marriage splice first and second dual braid ropes by using an elongated tool having a tip portion, each rope having a respective hollow core and a hollow cover, the method including the steps of:

(a) inserting the tip portion of the tool through the cover of each rope at a first position on each rope spaced from an adjacent end of each rope to generate respective first openings in the respective covers so as to determine a junction of the marriage splice for each rope, (b) withdrawing a portion of the core extending to the adjacent end of each rope through the respective first opening in the cover, so that a first core end portion and a first cover end portion extend separately from the first position of the rope, and a separate second core end portion and a second cover end portion extend separately from the first position of the second rope, (c) inserting the tip portion of the tool portion into the first core end portion at a second position closely adjacent the first position there, feeding the tool portion axially along the first core end portion in a direction away from the first position so that a length of the tool portion lies inside the first core end portion, and extending the tip portion of the tool portion outwardly from the first core end portion at a third position on the first core end portion, (d) threading the second cover end portion of the second rope through the tool portion and gripping the second cover end portion with the tip portion, (e) withdrawing the tool portion and the second cover end portion backwardly through the first core end portion of the first rope so as to draw a length of the second cover end portion in through the third position of the first rope and out from the second position of the first core end portion and separating the second cover end portion from the tool portion, (f) inserting the tip portion of the tool portion into the second core end portion at a second position closely adjacent the first position thereof, feeding the tool portion axially along the second core end portion in a direction away from the first position thereof so that a length of the tool portion lies inside the second core end portion, and extending the tip portion of the tool portion outwardly from the first core end portion at a third position on the first core end portion, (g) threading the first cover end portion of the first rope through the tool portion and gripping the first cover end portion with the tip portion, (h) withdrawing the tool portion and the first cover end portion backwardly through the second cover end portion of the second rope so as to draw a length of the first cover end portion in through the third position of the second rope and out from the second position of the second core end portion, and separating the first cover end portion from the tool portion, (i) cutting the first and second cover end portions to length closely adjacent the second position of the respective second and first core end portions, and stroking portions of the core and cover adjacent the respective second positions as required to smooth the cover end portion into the adjacent portion of the core end portion, (j) inserting the tip portion of the tool portion into the cover end portions at a fourth position adjacent the respective first position, feeding the tool portion axially along the first cover end portion in a direction away from the respective first position so that a length of tool portion lies inside the first cover end portion, and extending the tip portion of the tool portion outwardly from the first cover end portion at a fifth position on the first cover end portion, (k) threading the second core end portion of the second rope through the tool portion and gripping the core end portion with the tip portion, (l) withdrawing the tool portion and the second core end portion backwardly through the first cover end portion so as to draw a length of the core end portion in through the fifth position and out through the fourth position of the first cover end portion so that a first length of second core end portion extends within the first cover end portion from the fifth position to the fourth position thereof, and separating the core end portion from the tool portion, (m) inserting the tip portion of the tool portion in to the second cover end portion at a fourth position adjacent the respective first position, feeding the tool portion axially along the second cover end portion in a direction away from the respective first position so that a length of the tool portion lies inside the second cover end position, and extending the tip portion of the tool portion outwardly from the second cover end portion at a fifth position on the second cover end portion, (n) threading the core end portion of the first rope through the tool portion and gripping the core end portion with the tip portion, (o) withdrawing the tool portion and the first core end portion backwardly through the second cover end portion so as to draw a length of the first core end portion in through the fifth position and out through the fourth position of the second cover end portion so that a first length of the first cover end portion extends within the second cover end portion from the fifth position to the fourth position thereof, and separating the core end portion from the tool portion, (p) cutting the core end portion to length adjacent the fourth position and stroking portions of the rope as required to smooth the core end portion into the cover end portion.

13. A rope splicing apparatus having an elongated tool portion which includes:

(a) a main portion comprising a pair of generally straight and parallel main rod portions which are spaced apart at a main portion width along the length of the main portion;

(b) a tip portion comprising a generally U-shaped rod portion having two generally straight leg portions connected through a bend portion, the leg portions being spaced apart at a tip portion width which is narrower than the main portion width, (c) a transitional portion comprising a pair of short rod portions flaring outwardly from the leg portions of the tip portion to interconnect the main rod portions with the leg portions, (d) a handle portion having first and second end portions, (e) the main portion having a first end portion remote from the tip portion and hinged to the first end portion of the handle portion for swinging thereabouts, (f) a knife blade hinged to the second end portion of the handle for swinging thereabouts.

14. An apparatus as claimed in claim 13, in which:

(a) the rod portions of the main portion, the transitional portion and the tip portion comprise bent wire rod portions of similar diameters connected smoothly together.

15. An apparatus as claimed in claim 13, in which:

(a) the main portion has graduations thereon to reflect length measurements dependent on rope size to mark a portion of the rope prior to splicing.

16. An apparatus as claimed in claim 13, in which:

(a) ratio of the tip portion width to the main portion width is between about 1:1.4 and 1:1.9.

17. An apparatus as claimed in claim 13, in which:

(a) the tip portion has a tip portion length as measured between the transitional portion and the bend portion, (b) ratio of the tip portion width to the tip portion length is between about 1:1.2 and 1:1.8.

18. An apparatus as claimed in claim 13, in which:

(a) the leg portions of the tip portion are generally parallel to each other so that the tip portion width is essentially constant along the length of the said leg portions.

19. An apparatus as claimed in claim 13, in which:

(a) the rod portions of the main portion, the transitional portion and the tip portion are co-planar.

* * * * *